US008302792B2

(12) United States Patent
Logel et al.

(10) Patent No.: US 8,302,792 B2
(45) Date of Patent: Nov. 6, 2012

(54) CHILD-SAFE CLOSURE DEVICE WITH A DEFORMATION ENGAGEMENT SKIRT

(75) Inventors: Valere Logel, Levallois Perret (FR); Vincent Sebille, Etampes (FR)

(73) Assignee: Airsec S.A.S., Choisy le Roi (FR)

( * ) Notice: Subject to any disclaimer, the term of this patent is extended or adjusted under 35 U.S.C. 154(b) by 176 days.

(21) Appl. No.: 12/666,514

(22) PCT Filed: Jun. 4, 2008

(86) PCT No.: PCT/EP2008/056894

§ 371 (c)(1),
(2), (4) Date: Dec. 23, 2009

(87) PCT Pub. No.: WO2009/000616

PCT Pub. Date: Dec. 31, 2008

(65) Prior Publication Data

US 2010/0206877 A1 Aug. 19, 2010

(30) Foreign Application Priority Data

Jun. 28, 2007 (FR) ..... 07 04668

(51) Int. Cl.
*B65D 55/12* (2006.01)

(52) U.S. Cl. ..... 215/216; 215/217; 215/220; 215/256

(58) Field of Classification Search ..... 215/43, 215/44, 252, 329–331, 335–337, 216, 217, 215/220, 256; 220/212, 288, 801
See application file for complete search history.

(56) References Cited

U.S. PATENT DOCUMENTS 2,423,582 A * 7/1947 Coleman ..... 215/252
(Continued)

FOREIGN PATENT DOCUMENTS

EP 0111419 A1 6/1984
(Continued)

OTHER PUBLICATIONS

English translation of International Preliminary Report on Patentability pertaining to international application No. PCT/EP2008/056894, filed in the U.S. under U.S. Appl. No. 12/666,514. This IPRP may contain information material to the patentability of the current application.

*Primary Examiner* — Anthony Stashick
*Assistant Examiner* — Ned A Walker
(74) *Attorney, Agent, or Firm* — Scott R. Cox

(57) ABSTRACT

The invention is a child-safe closure device for a container (1) including i) a stopper having a base and a cylindrical side wall, the inside face of which has a screwthread and a first series of teeth (13), and ii) a collar (16) connected to the side wall and equipped with a second series of teeth (17), these two series of teeth engaged with corresponding series of teeth (4,7) positioned on a base of the neck (2) of the container (1), wherein a) the cylindrical side wall is made of a rigid zone (10), and a skirt (11), or a flexible and deformable zone, and b) the collar (16) is attached to the skirt (11) by frangible bridges (22), such that deformation of the skirt (11) does not result in deformation of the collar (16).

12 Claims, 3 Drawing Sheets

U.S. PATENT DOCUMENTS

| | | | | | |
|---|---|---|---|---|---|
| 3,831,797 | A | * | 8/1974 | Stevens, Jr. | 215/216 |
| 3,894,647 | A | * | 7/1975 | Van Montgomery | 215/216 |
| 3,917,097 | A | * | 11/1975 | Uhlig | 215/216 |
| 3,941,268 | A | * | 3/1976 | Owens et al. | 215/216 |
| 3,984,021 | A | * | 10/1976 | Uhlig | 215/216 |
| 4,117,945 | A | * | 10/1978 | Mumford | 215/216 |
| 4,134,513 | A | * | 1/1979 | Mumford | 215/216 |
| 4,376,497 | A | * | 3/1983 | Mumford | 222/153.14 |
| 4,413,743 | A | * | 11/1983 | Summers | 215/216 |
| 4,452,363 | A | | 6/1984 | Davis | |
| 4,494,665 | A | * | 1/1985 | Lehmann | 215/330 |
| 4,567,991 | A | * | 2/1986 | Anderson | 215/216 |
| 4,605,135 | A | * | 8/1986 | Ryder | 215/220 |
| 4,662,530 | A | * | 5/1987 | Goncalves et al. | 215/330 |
| 4,756,435 | A | * | 7/1988 | Schick et al. | 215/216 |
| 4,834,234 | A | * | 5/1989 | Sacherer et al. | 206/204 |
| 5,040,692 | A | * | 8/1991 | Julian | 215/252 |
| D327,644 | S | * | 7/1992 | Offley et al. | D9/560 |
| 5,213,225 | A | * | 5/1993 | King et al. | 215/330 |
| 5,219,084 | A | * | 6/1993 | King | 215/252 |
| 5,411,157 | A | * | 5/1995 | King et al. | 215/330 |
| 5,454,476 | A | * | 10/1995 | King et al. | 215/330 |
| 5,533,633 | A | * | 7/1996 | King | 215/252 |
| 5,577,624 | A | * | 11/1996 | Berta et al. | 215/221 |
| 5,638,969 | A | * | 6/1997 | King | 215/216 |
| 5,769,254 | A | * | 6/1998 | King et al. | 215/330 |
| 5,803,287 | A | * | 9/1998 | Kusz | 215/330 |
| 5,836,465 | A | | 11/1998 | King | |
| 5,927,527 | A | * | 7/1999 | Montgomery et al. | 215/219 |
| 6,015,054 | A | * | 1/2000 | King et al. | 215/252 |
| 6,227,391 | B1 | * | 5/2001 | King | 215/307 |
| 7,621,413 | B2 | * | 11/2009 | Miota et al. | 215/329 |
| 2004/0045923 | A1 | * | 3/2004 | Lancesseur et al. | 215/220 |
| 2007/0114140 | A1 | * | 5/2007 | Portier | 206/204 |
| 2010/0288765 | A1 | * | 11/2010 | Herrbach et al. | 220/212 |

FOREIGN PATENT DOCUMENTS

| | | | | |
|---|---|---|---|---|
| EP | 0763477 | | | 3/1997 |
| EP | 1002737 | A1 | * | 5/2000 |
| FR | 2339539 | | | 8/1977 |
| FR | 2916741 | A1 | * | 12/2008 |
| WO | WO9101924 | A1 | | 2/1991 |
| WO | WO 9722534 | A1 | * | 6/1997 |
| WO | WO9850283 | A1 | | 11/1998 |

* cited by examiner

CHILD-SAFE CLOSURE DEVICE WITH A DEFORMATION ENGAGEMENT SKIRT

FIELD OF THE INVENTION

The invention relates to a safety closure device for a container, the mouth of which is provided with an external screw thread, a child-proof device, in addition comprising a first-opening indicator and a dehydrating element.

The invention relates more particularly to a safety closure device by screwing for a container, comprising a single stopper to be screwed onto the said container, the said stopper having the ability to be disengaged from a locking position by means of a double lateral pressure, the said device being equipped in addition with a first-opening indicator collar cooperating with the neck of the container on which the closure device is mounted and a dehydrating element.

PRIOR ART

Closure devices offering safety for children, of the screw stopper type, may be of different natures. In particular the safety may be either the consequence of a deformation by opposing lateral pressure of the stopper allowing release of the unscrewing function, followed by the rotation of the stopper, or a vertical movement triggering a device allowing unscrewing, this vertical movement having to be conducted simultaneously with a rotation.

Child-safe stoppers functioning on the principle of a double vertical and rotation movement equipped with a first-opening indicator collar exist, but are relatively complex to implement since they involve the presence of an internal stopper to be screwed onto the said container and a coaxial external stopper entirely covering the internal stopper, the external stopper having the ability to drive the internal stopper by means of an engagement system, when an axial pressure and a rotation are practiced on the external stopper.

The following documents illustrate the various technical solutions proposed in the case of stoppers for which deformation by radial lateral pressure, exerted in opposition, on the skirt of the stopper, enables the unscrewing function to be released.

The document WO 9850283 describes a stopper with a child-safety screw of the single stopper type, operating on the method of a double opposed radial pressure and a rotation allowing unscrewing, the said stopper being equipped with a first-opening indicator collar. The stopper comprises, on its external bottom periphery, that is to say its skirt, two diametrically opposed zones on which lateral pressures can be exerted. Child-safety serrations in the form of protuberances, towards the inside of the stopper, enable the stopper to be locked with respect to rotation. These serrations are positioned at 90° from the pressure zones and extend downwards at the bottom level of the stopper skirt. First and second child-safety serrations are placed on the neck of the dedicated container with which the stopper is associated, and are positioned above the first-opening indicator collar. The connection between the first-opening indicator collar and the bottom part of the stopper is provided by breakable bridges positioned at 45° with respect to the pressure zones. It is important to dispense with the child safety before the first-opening indicator collar can be disconnected by rupture of the breakable bridges, a rupture obtained by contrasting rotation of the said collar when the stopper is rotated at the time of unscrewing. The first-opening indicator collar is removed after opening.

The document U.S. Pat. No. 4,452,363 describes a container equipped with a stopper with a child-safety screw with a first-opening indicator collar, the child safety being obtained by means of diametrically opposed lateral pressures exerted on the bottom part of the skirt of the stopper. The skirt is conical in shape and comprises a system of serrations and notches that enable the first-opening indicator collar to be connected and disconnected.

The document U.S. Pat. No. 5,836,465 describes a container equipped with a stopper with a child-safety screw with a first-opening indicator collar. The neck of the container comprises a screw thread and two first locking serrations below the screw thread, and diametrically opposed. The stopper is produced from material enabling the stopper skirt to be deformed under the effect of a lateral pressure. The internal part of the stopper comprises two second locking serrations positioned diametrically opposed on the internal bottom part of the deformable skirt. The first and second locking serrations have the ability to engage in each other when the stopper is completely screwed into the neck of the container and thus prevent any rotation of the stopper with respect to the neck of the container unless there is deformation of the said stopper, then releasing the locking system. The screw thread is of the multiple thread type, making it possible to disengage the stopper from the neck of the associated container by a simple rotation at 180° or less.

Such stoppers do not however have any functionalities for ensuring the controlled dehydration of the container with which they are associated, then forcing the use of separate dehydration means, in order to be able to be used in applications such as for example the packing and storage of moisture-sensitive products, such as in particular medications.

OBJECTIVES OF THE INVENTION

Numerous objectives are consequently assigned to the device according to the invention, so that it can afford designed solutions improved compared with the various means implemented in the known safety closure devices intended for packaging moisture-sensitive products.

A first object of the invention is to produce a safety closure device for a container by screwing, child-proof on unscrewing, this device being composed of a single stopper rather than, for reasons of simplicity and cost reduction, two stoppers fitted together, functioning by deformation of the skirt of the said stopper, thus releasing an engagement means, during the application of radial pressures exerted in opposition on two diametrically opposed zones of the deformable skirt of the said stopper of the device, followed by a rotation allowing unscrewing.

Another object of the invention is to produce a safety closure device for a container by screwing, child-proof on unscrewing, comprising a dehydrating means integrated in the said closure means and a tamper-evidence device of the first-opening indicator collar type.

Another object of the invention is to produce a safety closure device for a container by screwing, child-proof on unscrewing, comprising a dehydrating means integrated in the said closure means and a means of indicating a first opening cooperating with the neck of the container on which the closure device is screwed.

SUMMARY OF THE INVENTION

Consequently the invention concerns a child-safety closure device for a screwed container, composed of:

(i) a stopper enabling it to be screwed on the neck of a container with which it is associated, said stopper being composed of a bottom and a cylindrical lateral wall, comprising on its internal face a screw thread and a first set of so-called child-safety serrations, referred to as child-safety serrations, and (ii) a first-opening indicator collar, connected to a cylindrical lateral wall by breakable bridges, the said collar also being equipped, on its internal face, with a second set of serrations, referred to as tamper-evidence serrations, the first set and the second set of serrations cooperating with corresponding sets of serrations positioned on the base of the neck of the container, and which is characterised in that the cylindrical lateral wall of the stopper is formed by two zones, a first rigid and non-deformable top zone, of diameter d1, forming the body of the stopper, comprising the screw thread, and a second bottom zone of diameter d2, forming a flexible skirt deformable under a double centripetal lateral symmetrical pressure.

DETAILED DESCRIPTION OF THE INVENTION

The closure device for a screw container, according to the invention, is composed of a stopper with a screw thread enabling it to be screwed onto the neck of a container with which it is associated, the said stopper being composed of a bottom and a cylindrical lateral skirt, comprising internally in the part associated with the bottom a screw thread and in the open part, on its internal face, a first set of serrations, referred to as child-safety serrations, and a first-opening indicator collar, connected to the skirt by breakable bridges, the said collar also being equipped, on its internal face, with a second set of serrations, referred to as tamper-evidence serrations, the first set and the second set of serrations cooperating with corresponding serrations positioned on the base of neck of the container.

The stopper also comprises in its bottom a housing for storing a dehydrating composition or element, the said housing being inserted freely in the neck of the container.

The screw-thread closure device comprising a stopper and first-opening indicator collar is intended for a container of the type, for example an injection blow moulded bottle, comprising a neck preferentially with several threads and a steep pitch, intended to receive moisture-sensitive products that it is consequently necessary to keep in a dehydrated state.

According to the invention, the stopper comprises a cylindrical lateral wall formed by two zones, a first rigid non-deformable top zone, of diameter d1, forming the body of the stopper, comprising the screw thread, a second bottom zone of diameter d2, forming a flexible deformable skirt, under a double centripetal lateral symmetrical pressure, the top and bottom zones being connected together by a rigid shoulder. The diameter d1 is less than the diameter d2.

The flexible cylindrical skirt comprises two diametrically opposed gripping surfaces situated at the bottom periphery of the said skirt and making it possible to precisely position the force exerted by the thumb and index finger of the user of the device when the child-safety mechanism is released before unscrewing and opening of the said device. This skirt is made from a material such that the said skirt can be deformed, in particular ovalised, elastically, when a force is exerted on the two gripping zones and the skirt recovers its initial shape when this force ceases. The body and skirt of the stopper are in a single piece and therefore manufactured from the same material.

Preferentially, the wall thickness of the skirt is such that it allows easy deformation thereof when the pressure is exerted on the two gripping surfaces. On the other hand, the wall thickness of the body comprising the screw thread is such that the rigidity is reinforced. In addition the external surface of the body of the stopper is architectured so that a succession of concave shapes, facilitating the gripping of the stopper by hand, also increases the rigidity of the said body.

The maintenance of the rigidity of the body of the stopper while the skirt is deformable and deformed by lateral pressures makes it possible not to risk impairing the unscrewing and screwing performance of the screw thread.

The skirt of the stopper comprises, on its internal face, a first set of two serrations, referred to as child-safety serrations, positioned respectively on the internal face of the skirt of the stopper, diametrically opposite each other, on a diameter itself parallel to the orientation plane of the two gripping surfaces and the function of which is to prevent the rotation of the stopper when the skirt is not deformed during an attempt at unscrewing the device, by cooperating with two corresponding serrations disposed on the neck of the associated container. On the other hand, when the skirt is deformed, that is to say ovalised by double pressure exerted on the two diametrically opposed gripping surfaces, situated at the bottom periphery of the skirt of the stopper, then there is a separation of the two serrations in the first set of serrations secured to the skirt, with respect to the two corresponding serrations situated on the neck of the container, and consequently a possibility of rotation and therefore of unscrewing of the device.

The two serrations in the first set of serrations present on the internal surface of the skirt of the stopper have a height such that they cooperate with the corresponding two serrations situated on the neck of the associated container.

The diametral plane passing through the abrupt faces of the two opposite serrations in the first set of serrations positioned inside the skirt of the stopper is perpendicular to the diametral plane merging with the bisecting plane of symmetry of the gripping surfaces situated on the bottom part of the skirt of the stopper.

The stopper thus remains locked with respect to rotation when the said skirt is its non-deformed state, that is to say not ovalised. The freedom of rotation of the stopper is regained when the said skirt is put in an ovalised state, thus causing the pulling away of the breakable bridges by rotation of the stopper since the first-opening indicator collar is not able to follow this rotation. This movement causes the disconnection of the first-opening indicator collar with respect to the stopper.

The serrations in the first set of so-called child-safety serrations are positioned in a plane perpendicular to the two gripping surfaces. Preferentially, the axial plane formed by the abrupt faces of the two diametrically opposed serrations of the first set of serrations is perpendicular to the axial plane formed by the abrupt faces of the two serrations in the second set of so-called tamper-evidence serrations constituting the means of locking the first-opening indicator collar, situated in the axial plane of symmetry of the gripping zones. The two serrations in the first set of so-called child-safety serrations are distributed in a regular fashion, also for reasons of balancing of force when the child-safe closure device is unscrewed and for reasons of ease of mould design. The positioning on two perpendicular planes of the tamper-evidence serrations with respect to the child-safety serrations limits the undercut angle of orientation of the abrupt faces of the serrations to a low value, for reasons of ease of moulding and better locking of a serration on its opposite number.

The profile of the serrations in the first set of serrations present on the internal part of the skirt of the stopper and on the outside of the neck of the associated container is such that it enables the stopper to be screwed, by virtue of a profile with a gentle slope, giving rise to a slight deformation of the skirt of the stopper, but does not allow unscrewing thereof, through an abrupt profile that prevents any rotation of the said non-deformed skirt during the unscrewing of the closure device.

The height of the two serrations positioned on the neck of the container, cooperating with the two serrations in the first set of serrations, is such that the said serrations are positioned towards the bottom before the area of the screw thread on the neck of the container, and extend as far as the level of the peripheral bottom zone of the first-opening indicator collar, when the latter is in place, all the other serrations having a lower height.

Such a height makes it possible, if required, also to lock the two serrations in the second set of serrations present inside the first-opening indicator collar, if they happen to pass over the two corresponding dedicated serrations on the neck of the container, with which they cooperate.

In addition, the difference in diameter between d1 and d2 affords an optimised contact surface homogeneous over the entire height of the serrations and reinforces child safety.

In a variant, two additional tamper-evidence serrations positioned on the inside of the collar are provided for cooperating with the bottom part of the corresponding serrations positioned on the neck of the container. They are consequently positioned in a plane perpendicular to the first set of tamper-evidence serrations.

The stopper of the child-safety closure device according to the invention comprises a first-opening tamper-evidence collar, secured by means of breakable bridges to the skirt of the stopper, the said bridges being positioned on the bottom annular periphery of the skirt of the stopper.

The first-opening indicator collar has, on its internal surface, a second set of two so-called tamper-evidence serrations, the function of which is to prevent the rotation thereof, when the device is unscrewed, by cooperating with the two corresponding serrations disposed on the neck of the associated container, with a view to causing the rupture of the bridges by shearing.

The two serrations in the second set of serrations present on the internal surface of the said collar, when integral with the stopper, are of a height such that they cooperate with the two corresponding serrations present on the neck of the container.

The rupture of the breakable bridges connecting the top circumference of the collar to the bottom circumference of the skirt of the stopper takes place by shearing at the time of first opening and thus represents tamper evidence. The two serrations in the second set of serrations are regularly distributed on the circumference of the collar and on the neck of the container with regard to their opposite numbers with which they cooperate.

The two serrations in the second set of so-called tamper-evidence serrations are positioned in line with the two gripping surfaces. Preferentially the diametral plane passing through the two abrupt faces of the two serrations in the second set of serrations, positioned inside the first-opening indicator collar, is in the diametral plane of symmetry of the two diametrically opposed gripping zones, positioned on the external surface of the skirt of the stopper. The two serrations in the second set of serrations positioned on the internal surface of the first-opening indicator collar, engaged in the corresponding two serrations positioned on the neck of the container, mean that the collar remains locked with respect to rotation, consequently causing the pulling away of the breakable bridges and therefore the disconnection of the collar with respect to the stopper. This engagement of the serrations in the second set of serrations is reinforced by the fact that the pressure exerted on the two diametrically opposed gripping zones, and positioned in line with these two serrations in the second set of serrations cooperating with the corresponding serrations positioned on the neck of the container. The purpose of the presence of a set of two tamper-evidence serrations positioned on either side of the gripping zones is to guarantee that the tamper-evidence serrations are in engagement with the corresponding serrations on the neck of the container, the deformation of the external skirt mainly being transmitted to the tamper-evidence collar through the tamper-evidence bridges.

The first-opening indicator collar is connected to the skirt by breakable bridges, so that the deformation of the skirt does not cause an equivalent deformation of the collar.

The breakable bridges are preferentially four in number, distributed close to and on either side of each serration in the second set of serrations situated on the internal face of the collar.

Thus the bridges, taken two by two, are situated close to and on either side of the serrations in the second set of so-called tamper-evidence serrations.

This provision makes it possible to transmit the deformation of the gripping zones to the first-opening indicator collar, when ovalisation of the skirt is caused, and consequently to better lock the collar in its rotation, thus enabling facilitated rupture of the bridges.

This provision is also favoured for reasons of balancing of shearing force at the first unscrewing of the child-safety closure device, and also for reasons of ease of mould design.

In a less preferential design, six bridges can also be considered.

The two serrations in the second set of serrations are distributed at 180° over the circumference of the neck of the container and over the circumference of the first-opening indicator collar, the diametral plane defining the abrupt face of these serrations being perpendicular to the diametral plane defining the abrupt face of the two serrations in the first set of serrations. This regular circumferential distribution allows a balancing of force when the child-safe closure device is unscrewed. Such a regular distribution is also so for reasons of ease of mould design.

The profile of the serrations in the second set of serrations present on the internal part of the first-opening indicator collar and on the outside of the neck of the associated container is such that it allows the screwing of the stopper and the positioning of the connected collar, by virtue of a profile with a gentle ramp, causing a deformation of the first-opening tamper-evidence collar, but does not allow its unscrewing without rupturing of the bridges connecting the first-opening indicator collar to the bottom part of the skirt of the stopper, through an abrupt profile that prevents any rotation of the said collar when the closure device is unscrewed.

Finally, and more precisely, the profiles of the serrations in the first and second sets of serrations, when observed on a cutting plane perpendicular to the rotation axis, comprise a gentle ramp, followed by an abrupt slope, the profiles of the serrations with which they cooperate being disposed in an opposing fashion, so that, for two cooperating serrations, the gentle slopes slide on each other on closure and the abrupt slopes lock on opening.

The serrations in the second set of serrations disposed on the neck of the container are situated below the serrations in the first set of serrations fulfilling the child-safety function. They have a height less than that of the serrations in the first set of serrations and correspond substantially to the height of the first-opening indicator collar.

Any attempt at rotation of the first-opening indicator collar integral with the stopper, when the stopper is unscrewed, causes the rupture of the breakable bridges connecting the top periphery of the collar to the bottom periphery of the skirt of the stopper, since this collar is locked with respect to rotation by the serrations disposed on the neck of the container, while the stopper for its part can make this rotation.

On unscrewing, at first opening, the two serrations in the second set of serrations lock the rotation of the tamper-evidence collar, the first-opening indicator, causing the breakage of the breakable bridges. This first-opening indication function is thus activated.

Continuation of the unscrewing can be effective only through a pressure on the two diametrically-opposed gripping surfaces positioned in the bottom part of the peripheral skirt of the stopper. This pressure causes ovalisation of the cylindrical part of the skirt and releases the two anti-rotation serrations: the child safety function is then deactivated.

Thus the gripping surfaces are defined on the flexible part of the skirt of the stopper in order to represent the points where the forces are applied. The first-opening indicator collar is connected to the external skirt of the stopper by two sets of two breakable bridges, each breakable bridge being situated on either side of the two gripping surfaces. Thus the deformation applied to the gripping surfaces is for the main part transmitted to the tamper-evidence collar guaranteeing contact between the serrations in the second set of so-called tamper-evidence serrations and the corresponding serrations positioned on the neck of the container. The security of operation of the tamper-evidence operating security is reinforced thereby.

It is also clear that the first-opening indicator collar connected to the skirt by the two sets of breakable bridges, disposed on either side of the two gripping surfaces, deforms in the same way as the skirt in the gripping surfaces but does not undergo a deformation equivalent to that of the skirt in the perpendicular plane because it is not connected in these zones to the skirt by bridges.

According to the invention, the seal between the internal part of the neck of the container and the threaded stopper is provided by means of a cylindrical element, coaxial and concentric with the stopper, positioned inside the stopper by bearing on the bottom of said stopper. This cylindrical element fits, by means of an end bevel, in the neck of the container through the fact that its outside diameter is adjusted to the inside diameter of the neck of the container and it is of a certain height.

The stopper of the child-safe closure device according to the invention also comprises a dehydrating means of the attached type, the dehydrating agent being placed in an appropriate housing, situated on the bottom of the internal stopper, the said housing being closed by a closure means not impervious to ambient moisture, for example a membrane made from porous cardboard, to ensure the rapid desiccation of the moisture-sensitive products packaged in the container.

The housing is thus coaxial and concentric with the stopper, and is freely inserted in the neck of the container.

The dehydrating agent used in the container is chosen from the group consisting of silica gels, molecular sieves, diatomaceous earths or other dehydrating products, in a powdery form or deposited on a powdery carrier. They can also be in the form of mixtures.

The dehydrating agent can also be a capsule contained in the said housing and produced from a dehydrating polymer material containing or not dehydrating fillers and more generally from any material containing a dehydrating agent.

Like the safety closure devices belonging to the prior art, the stopper of the device according to the invention is produced by injection moulding from thermoplastic polymers preferentially chosen from the group consisting of polyethylenes, polypropylenes and ethylene/propylene copolymers used above or in a mixture, formulated or not.

Other thermoplastic polymers can also be used, such as polyamides (PA), polystyrenes (PS), acrylonitrile-butadiene-styrene copolymers (ABS), styrene-acrylonitrile copolymers (SAN), polymethyl methacrylates (PMMA), polyethyleneterephthalates (PET), polybutyleneterephthalates (PBT), polyacetals (POM), polyvinyl chlorides (PVC) and polycarbonates (PC). Semi-rigid elastomers can also be envisaged.

Thermoplastic elastomers can be added to such compositions formulated from the aforementioned thermoplastic polymers.

The invention will be better understood by means of the description, with reference numbers, of the figures mentioned below, these figures having only an illustrative and non-limitative character.

FIG. 1 is a perspective view from above of the container (1) on which the child-safe closure device with first-opening indicator collar (16) is screwed.

Figure 1:
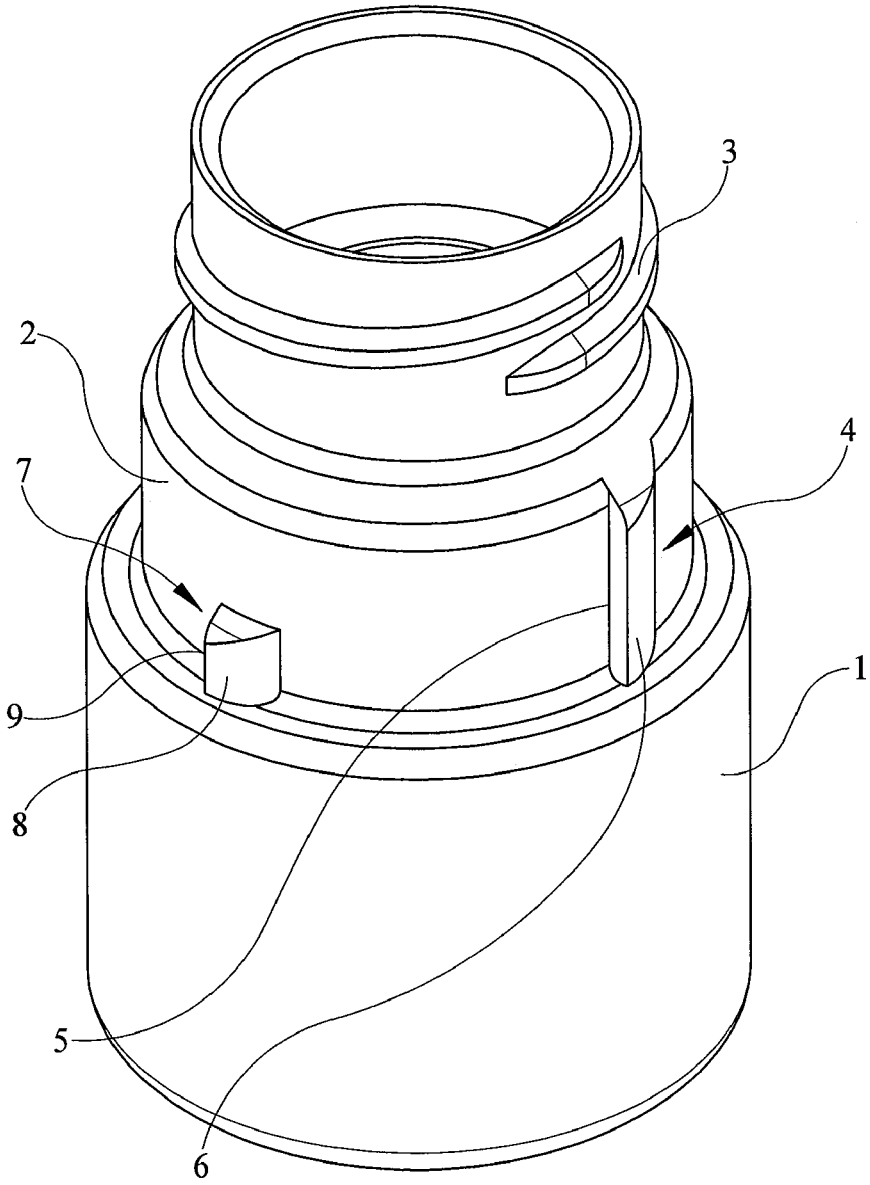
FIG. 1 is a perspective view from above of the container onto which the child-safe closure device with a first-opening indicator collar is screwed.

The container comprises a neck (2) equipped with a screw thread (3) and a first set of two serrations (4) fulfilling the function of child safety, cooperating with the corresponding notches situated on the inside of the skirt (11) of the stopper of a the closure device, only one of which is visible in FIG. 1, and a second set of two serrations (7) fulfilling the function of locking the first-opening indicator collar, when cooperating with the corresponding serrations situated on the inside of the said collar, only one of which also is visible in FIG. 1.

The serration (4) in the first set of serrations has a profile with a gentle ramp, represented by the face (5) supplemented by an abrupt profile represented by the face (6).

The serration (7) in the second set of serrations comprises a profile with a gentle ramp, represented by the face (8) supplemented by an abrupt profile represented by the face (9).

Figure 2:
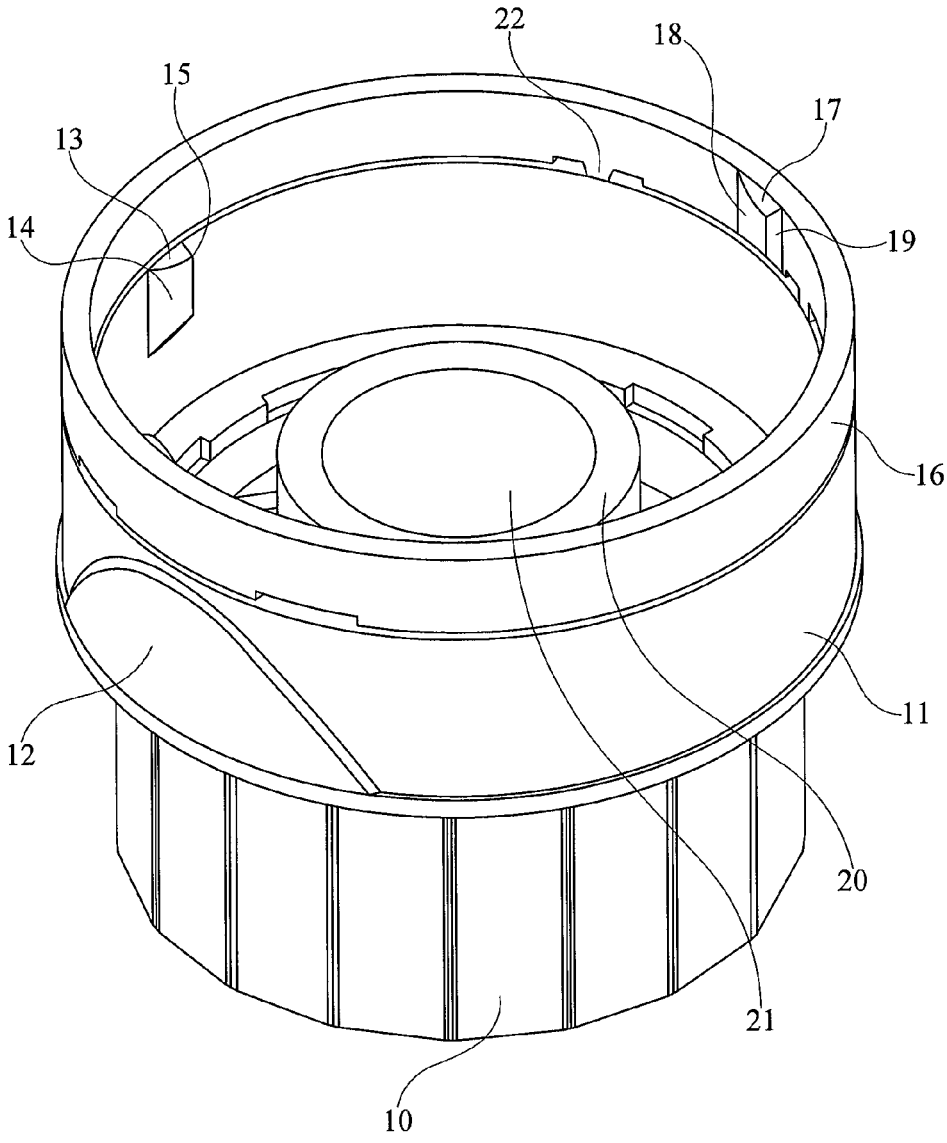
FIG. 2 is a perspective view from below of the closure device and more specifically of the stopper, showing in particular a serration in the first set of serrations positioned inside the skirt of the stopper and a serration positioned at 90° from the previous serration, and belonging to the second set of serrations positioned inside the first-opening indicator collar.

FIG. 2 is a perspective view from below of the closure device and more specifically of the stopper.

The stopper is composed of a cylindrical lateral wall formed by two zones, a first rigid and non-deformable top zone (10), of diameter d1, forming the body of the stopper, comprising the screw thread, a second body zone of diameter d2, forming a flexible deformable skirt (11), under a double centripetal lateral symmetrical pressure, the top and bottom zones being connected together by a rigid shoulder (24). The skirt (11) is equipped with two gripping surfaces (12) formed by a flat, only one of which is visible. The stopper also comprises a housing (20) for inserting a dehydrating material closed off by a porous membrane (21).

The stopper also comprises a first-opening indicator collar (16) showing in particular a serration (13) in the first set of serrations positioned inside the skirt (11) of the stopper and a serration (17) positioned at 90° from the previous serration, and belonging to the second set of serrations positioned inside the first-opening indicator collar (16).

The serration (13) in the first set of serrations situated on the inside of the internal face of the skirt (11) of the stopper comprises a profile with a gentle ramp, represented by the face (14) supplemented by an abrupt profile represented by the face (15).

The serration (17) in the second set of serrations situated on the inside of the internal face of the first-opening indicator collar (16) comprises a profile with a gentle slope, represented by the face (18) supplemented by an abrupt profile represented by the face (19).

The breakable bridges (22) connect the first-opening indicator collar (16) to the skirt (11) of the stopper.

Figure 3:
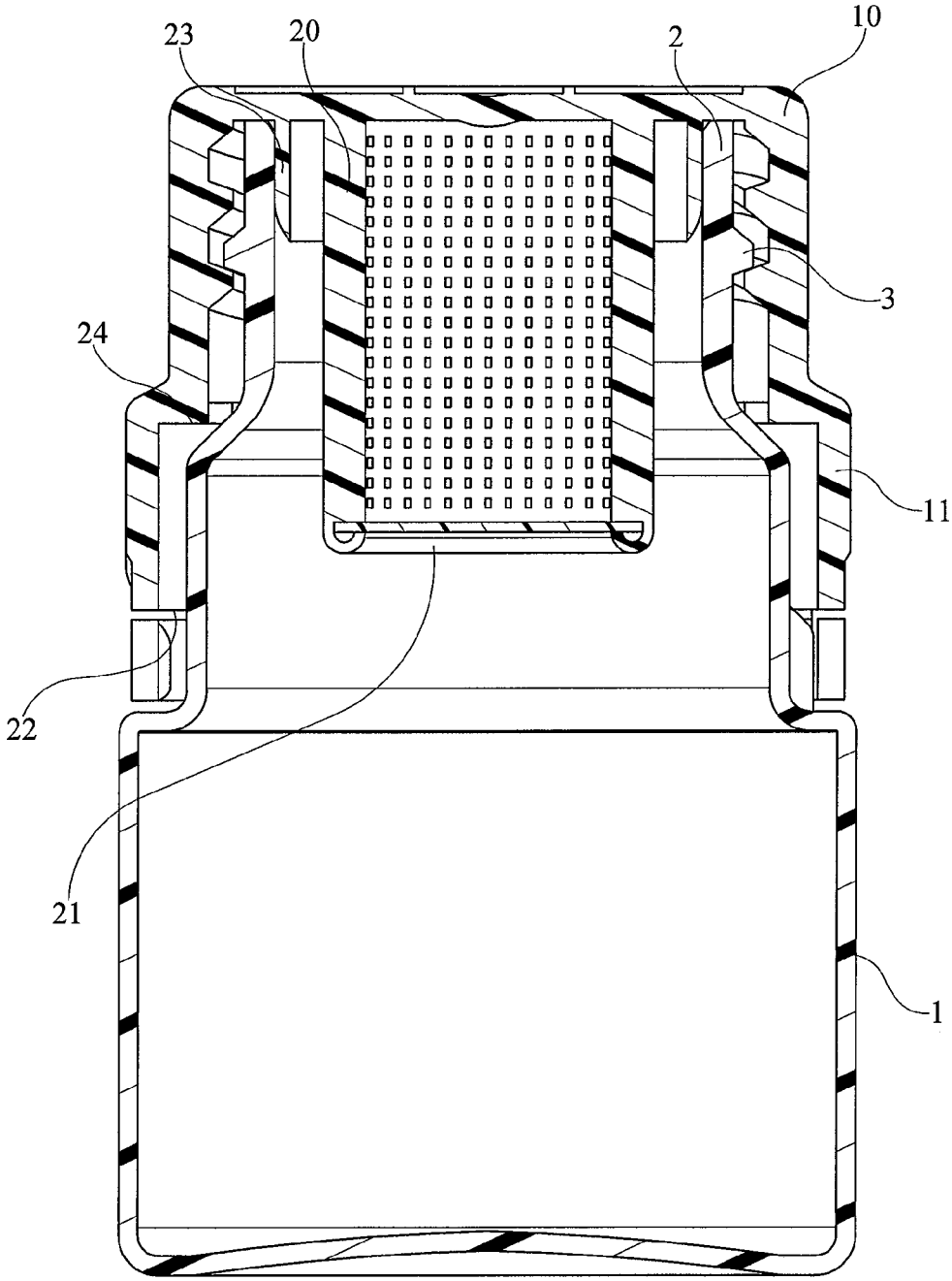
FIG. 3 is a transverse section of the dehydrating closure device, with child safety and first-opening indicator collar, mounted by screwing on the corresponding container according to the invention.

FIG. 3 shows a transverse section of the dehydrating closure device, with child safety and first-opening indicator collar (16), mounted by screwing on the corresponding container (1) according to the invention. The first-opening indicator collar (16) is also connected, by means of the breakable bridges (22), to the skirt (11) of the stopper (10).

The stopper also comprises a cylindrical sealing zone (23) fitting in the neck (2) of the container (1) equipped with its screw thread (3).

The stopper also has, in its bottom, a housing (20) filled with a dehydrating material, retained by means of a porous membrane (21).

The invention claimed is:

1. A child-safety container and closure device comprising:
- a container comprising:
  - an open top end and a closed base;
  - a sidewall extending upward from the closed base;
  - a neck extending between the sidewall and the open top end, the neck comprising:
    - an upper annular wall extending downward from the open top end, the upper annular wall having an outer screw thread; and,
    - a lower annular wall having a first set of outer serrations and a second set of outer serrations;
- a cap comprising:
  - a closed top for closing the open top end of the container, the closed top having an outer edge and a bottom surface;
  - an outer cylindrical skirt extending downward from the outer edge of the closed top, the outer cylindrical skirt comprising:
    - an upper skirt portion having a first diameter and an inner screw thread, the upper skirt portion being rigid and non-deformable;
    - a lower skirt portion having a second diameter, a bottom end, two diametrically opposed outer gripping surfaces, and inner child-safety serrations, each inner child-safety serration having a ramp surface connected to a steep declining surface, the lower skirt portion being deformable;
    - a bottom end; and,
    - wherein the first diameter is less than the second diameter;
  - an interior housing extending downward from the bottom surface of the closed top;
  - a first-opening indicator collar, connected to the bottom end of the outer cylindrical skirt by breakable bridges, the first-opening indicator collar having inner tamper-evidence serrations, each tamper-evidence serration having a ramp surface connected to a steep declining surface;
  - wherein the inner child-safety and tamper-evidence serrations oppose the first and second sets of outer serrations on the neck of the container, and the first and second sets of outer serrations:
    - (i) slide along the ramp surfaces of the inner child-safety and tamper evidence serrations when closing the container, and
    - (ii) lock against the steep declining surfaces of the inner child-safety and tamper evidence serrations when opening the container,
  - wherein double centripetal lateral symmetrical pressure exerted on the two diametrically opposed gripping surfaces deforms the lower skirt portion and the first opening indicator collar causing the tamper-evidence serrations to cooperate with the second set of outer serrations on the neck of the container.

2. The child-safety container and closure device according to claim 1, wherein the inner child-safety serrations are a pair of diametrically opposed serrations positioned on the interior of the lower skirt portion, and cooperate with the first set of outer serrations.

3. The child-safety container and closure device according to claim 1, wherein the tamper-evidence serrations are aligned with the two gripping surfaces.

4. The child-safety container and closure device according to claim 1, wherein the child-safety and tamper-evidence serrations are disposed in perpendicular planes.

5. The child-safety container and closure device according to claim 1, wherein the breakable bridges are four breakable bridges.

6. The child-safety container and closure device according to claim 5, wherein two of the four bridges are proximal and adjacent to the tamper-evidence serrations.

7. The child-safety container and closure device according to claim 1, the interior housing of the cap further comprising a dehydrating element.

8. The child-safety container and closure device according to claim 7, the dehydrating element further comprising a suitable housing and a dehydrating agent, wherein the suitable housing is closed by a closure element not impervious to moisture.

9. The child-safety container and closure device according to claim 8, wherein the dehydrating agent is chosen from the group consisting of silica gels, molecular sieves and diatomaceous earths, wherein said dehydrating agent is in a powdery form, or deposited on a powdery support, or in the form of a capsule produced from a polymer material containing dehydrating fillers.

10. The child-safety container and closure device according to claim 1, the cap further comprising an interior coaxial cylindrical element cooperating with a beveled rim of the open top end to form a seal.

11. The child-safety container and closure device according to claim 1, wherein the child-safety container and closure device is produced from the group consisting of: polyethylenes, polypropylenes, ethylene/propylene copolymers used alone or in a mixture, formulated or not, polyamides (PA), polystyrenes (PS), acrylonitrile-butadiene-styrene copolymers (ABS), styrene-acrylonitrile copolymers (SAN), polymethyl methacrylates (PMMA), polyethyleneterephthalates (PET), polybutyleneterephthalates (PBT), polyacetals (POM), polyvinyl chlorides (PVC) and polycarbonates (PC).

12. The child-safety container and closure device according to claim 11, wherein the compositions are formulated from thermoplastic polymers containing thermoplastic elastomers.

* * * * *